US010456901B2

(12) United States Patent
Chiang

(10) Patent No.: US 10,456,901 B2
(45) Date of Patent: Oct. 29, 2019

(54) TORQUE DRIVING TOOL

(71) Applicant: William Tools Co., Ltd., Taichung (TW)

(72) Inventor: Shui-Lai Chiang, Taichung (TW)

(73) Assignee: WILLIAM TOOLS CO., LTD., Taichung (TW)

( * ) Notice: Subject to any disclaimer, the term of this patent is extended or adjusted under 35 U.S.C. 154(b) by 19 days.

(21) Appl. No.: 15/860,018

(22) Filed: Jan. 2, 2018

(65) Prior Publication Data

US 2018/0207787 A1 Jul. 26, 2018

(30) Foreign Application Priority Data

Jan. 25, 2017 (TW) ..... 106102948 A

(51) Int. Cl.
*B25G 1/08* (2006.01)
*B25B 23/14* (2006.01)
*B25B 23/142* (2006.01)

(52) U.S. Cl.
CPC ..... *B25G 1/085* (2013.01); *B25B 23/141* (2013.01); *B25B 23/1427* (2013.01)

(58) Field of Classification Search
CPC .... B25G 1/085; B25B 23/141; B25B 23/1427
USPC ..... 81/474
See application file for complete search history.

(56) References Cited

U.S. PATENT DOCUMENTS 4,926,721 A * 5/1990 Hsiao ..... B25F 1/02 81/124.4
5,887,306 A * 3/1999 Huang ..... B25B 13/5091 7/165
5,916,277 A * 6/1999 Dallas ..... B25F 1/003 30/143
6,378,701 B1 * 4/2002 Kuo ..... B25B 15/008 206/378
7,174,814 B2 * 2/2007 Liao ..... B25G 1/066 81/177.4
7,484,442 B1 * 2/2009 Chen ..... B25B 23/1427 81/474
8,051,751 B2 * 11/2011 Huang ..... B25B 23/1427 81/467

FOREIGN PATENT DOCUMENTS

TW 408663 U 10/2000

* cited by examiner

*Primary Examiner* — Hadi Shakeri
(74) *Attorney, Agent, or Firm* — Muncy, Geissler, Olds & Lowe, P.C.

(57) ABSTRACT

A torque driving tool is provided, including a grip portion and at least one receiving device. The grip portion has at least one receiving groove. Each said receiving device includes a cover and a receiving portion for at least one said driving bit to be received therein, the cover is pivoted to the grip portion, and the receiving portion is swingably pivoted to the cover.

9 Claims, 5 Drawing Sheets

TORQUE DRIVING TOOL

BACKGROUND OF THE INVENTION

Field of the Invention

The present invention relates to a hand tool.

Description of the Prior Art

Generally, to screw a screwing member on an object, a user uses a tool which has a grip and a driving bit, the user grips on the grip and inserts the driving bit on the screwing member to rotate the screwing member. In addition, the driving bit gradually wears out after being used for a period of time, and the screwing members in different specifications needs to cooperate with driving bits which correspond to the screwing members in dimension; therefore, the user needs to carry many driving bits in various dimensions for different requirements. For convenience, on the market, there is a grip which is formed with a receiving portion, and the receiving portion is for a plurality of driving bits to be received therein, so the user does not need to carry a driving bit storage box, and s/he only needs to take down the driving bits from the receiving portion of the grip to replace the driving bits. This type of screwdriver handle is disclosed in TW408663.

However, although the conventional screwdriver handle can receive the driving bits, the driving bits are tightly arranged in the receiving portion to save space, and it's hard for the user to take up just one driving bit. On contrast, if the driving bits are spacingly arranged in the receiving portion, the receiving portion will occupy too much space, and a volume of the grip will largely increase.

The present invention has arisen to mitigate and/or obviate the afore-described disadvantages.

SUMMARY OF THE INVENTION

The major object of the present invention is to provide a torque driving tool which can save a space of a receiving device and for a user to take up a driving bit conveniently.

To achieve the above and other objects, a torque driving tool is provided, including a main body, a working portion, a grip portion and at least one receiving device. The main body has an axial direction. The working portion is disposed on one of two ends of the main body for being assembled to a driving bit, and when the working portion receives a torque which is greater than a set torque value, the working portion slips relative to the main body. The grip portion is disposed on one of the two ends of the main body opposite to the working portion and optionally rotatable relative to the main body to adjust the set torque value, and the grip portion has at least one receiving groove. Each said receiving device includes a cover and a receiving portion which is for at least one said driving bit to be received therein, the cover is pivoted to the grip portion, and the receiving portion is swingably pivoted to the cover.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
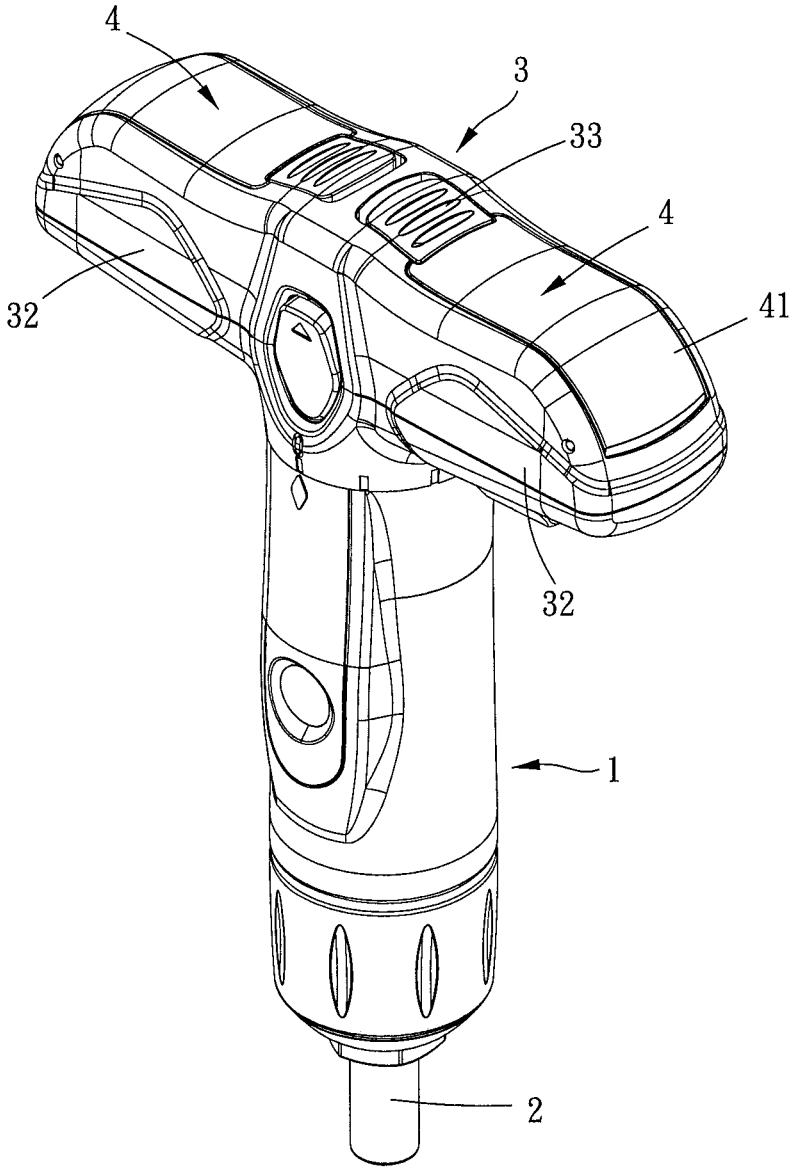
FIGS. 1 and 2 are stereograms of a preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 5 for a preferred embodiment of the present invention. A torque driving tool includes a main body 1, a working portion 2, a grip portion 3 and at least one receiving device 4. The main body 1 has an axial direction. The working portion 2 is disposed on one of two ends of the main body 1 for being assembled to a driving bit 9, and when the working portion 2 receives a torque which is greater than a set torque value, the working portion 2 slips relative to the main body 1.

The grip portion 3 is disposed on one of the two ends of the main body 1 opposite to the working portion 2 and optionally rotatable relative to the main body 1 to adjust the set torque value, and the grip portion 3 has at least one receiving groove 31. In this embodiment, there are two said receiving grooves 31.

Each said receiving device 4 includes a cover 41 and a receiving portion 42 which is for at least one said driving bit 9 to be received therein, the cover 41 is pivoted to the grip portion 3, and the receiving portion 42 is swingably pivoted to the cover 41.

In addition, in this embodiment, the grip portion 3 includes an upper shell 34 and a lower shell 35 which are assembled to each other, the lower shell 35 is close to the main body 1, the upper shell 34 is remote from the main body 1, one side of the upper shell 34 remote from the main body 1 has the two receiving grooves 31, an actuating member 36 is non-rotatably arranged in the lower shell 35, the main body 1 has a torque adjusting member 11, the torque adjusting member 11 is non-rotatably inserted in the actuating member 36, and the grip portion 3 is optionally axially movable between a locked position and an adjustable position; when the grip portion 3 is on the locked position, the grip portion 3 and the main body 1 are non-rotatable relative to each other; and when the grip portion 3 is on the adjustable position, the grip portion 3 is rotatable relative to the main body 1, and the actuating member 36 drives the torque adjusting member 11 to rotate to adjust the set torque value.

Figure 2:
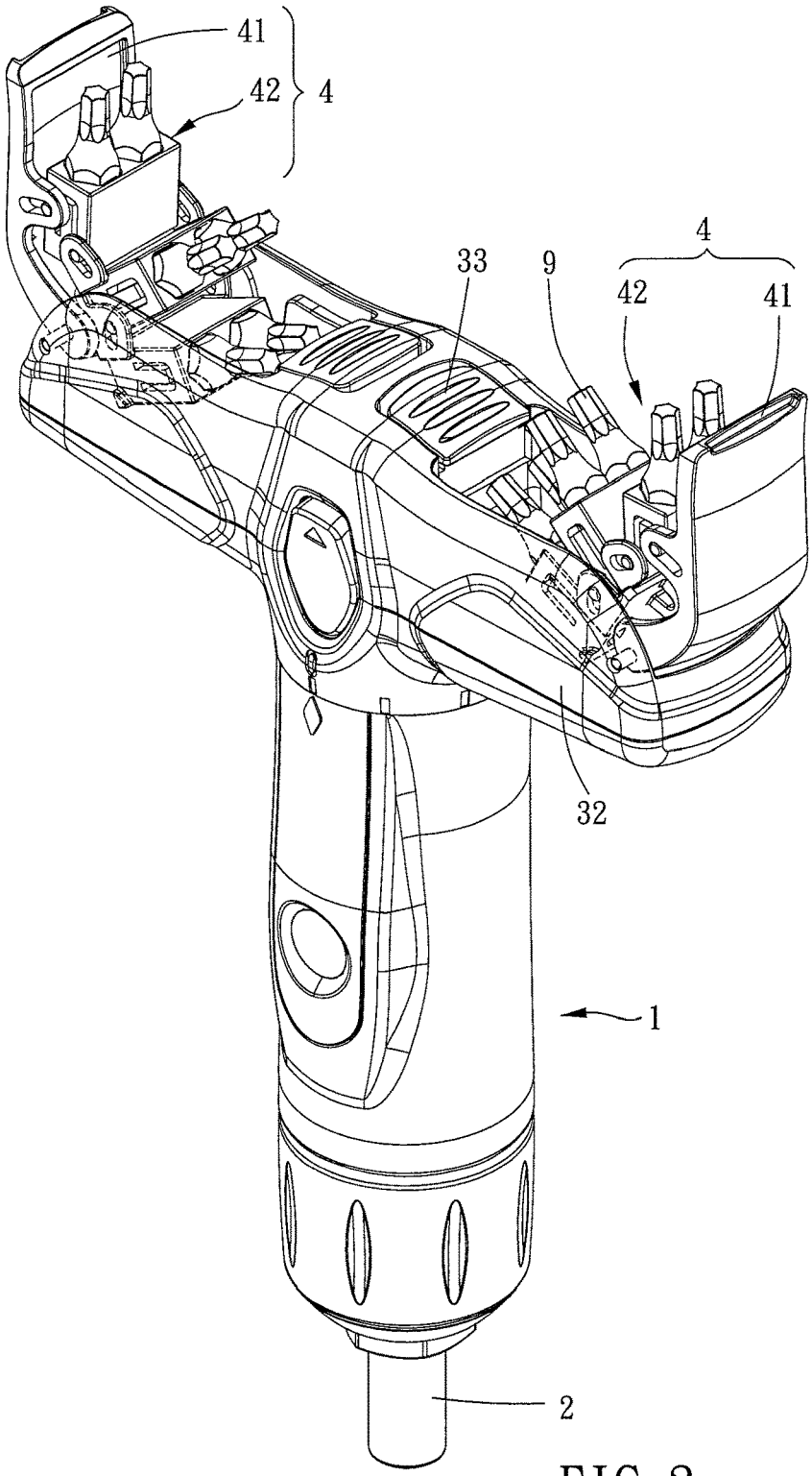
Figure 3:
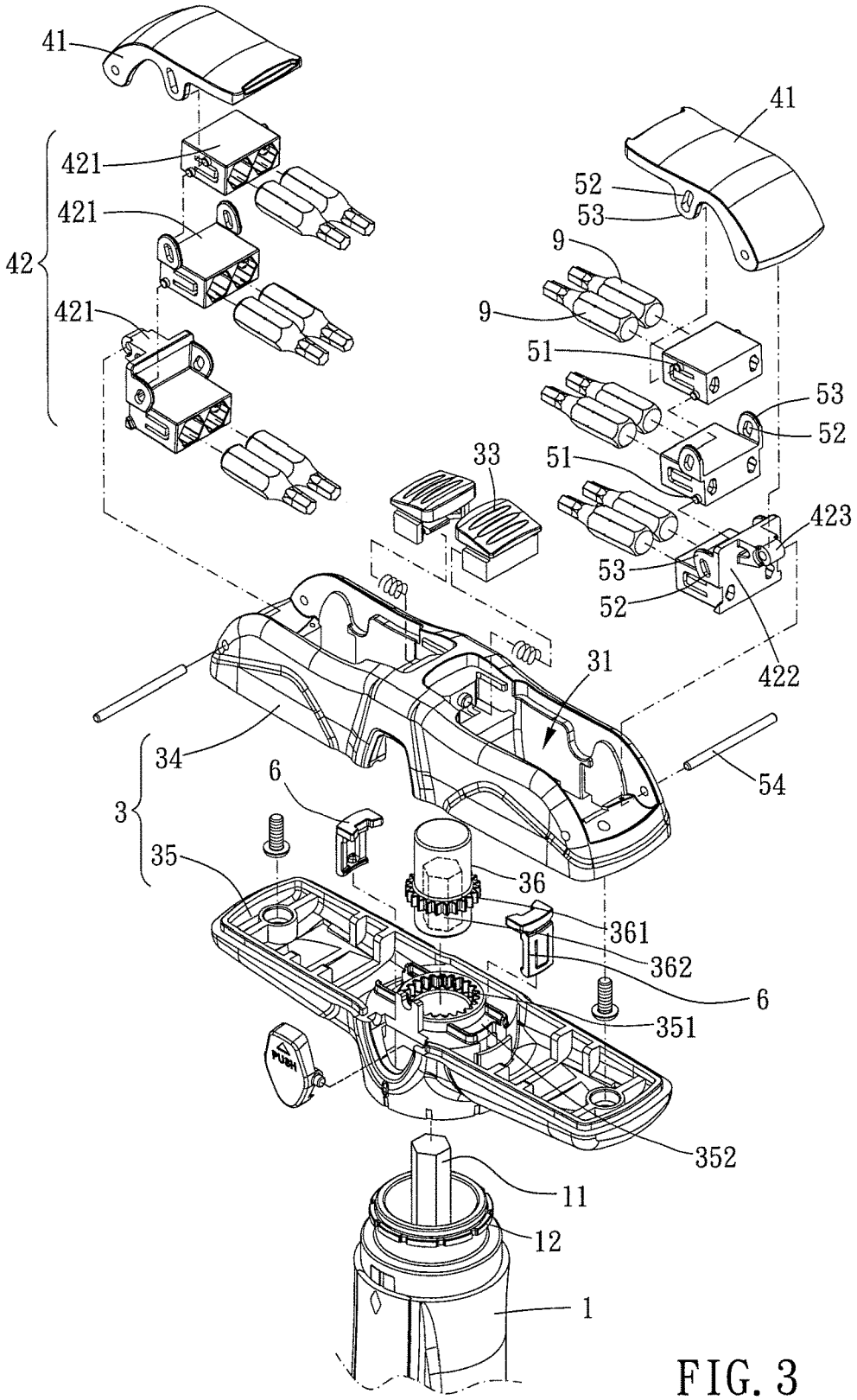
FIG. 3 is a breakdown view of the preferred embodiment of the present invention.

Specifically, an outer circumferential wall of the actuating member 36 has an exterior annular toothed portion 361 (as shown in FIG. 2), the lower shell 35 has an interior annular toothed portion 351 which is optionally meshed with the exterior annular toothed portion 361, when the interior annular toothed portion 351 is non-meshed with the exterior annular toothed portion 361, a relative angle of the grip portion 3 and the main body 1 is adjustable by rotating the grip portion 3 and the actuating member 36 relative to each other, the actuating member 36 further has a non-circular through hole 362, the torque adjusting member 11 is inserted through the non-circular through hole 362, and the torque adjusting member 11 corresponds to the non-circular through hole 362 in shape so that the torque adjusting member 11 comoves with the actuating member 36.

Preferably, the torque driving tool further includes at least one restricting member 6, in this embodiment, there are two said restricting members 6, one of the two ends of the main body 1 near the grip portion 3 further has an engaging portion 12, the lower shell 35 further has at least one position-restricting portion 352, one of two ends of each said restricting member 6 is engaged with one said position-restricting portion 352, when the grip portion 3 is on the locked position, the restricting members 6 are non-engaged with the engaging portion 12; when the grip portion 3 is on the adjustable position, the restricting members 6 are engaged with the engaging portion 12 to prevent the grip portion 3 from falling off from the main body 1.

The grip portion 3 has at least one arm portion 32 which extends radially, each said arm portion 32 has one said receiving groove 31, and the covers 41 are respectively pivoted to one of two ends of the arm portions 32 which are radially away from each other. In this embodiment, the grip portion 3 has two said arm portions 32, the two arm portions 32 are linearly arranged and form a T shape with the main body 1, and in other embodiments, the grip portion 3 may have arm portions 32 in other numbers.

The receiving portion 42 includes a plurality of receiving members 421, the receiving members 421 are respectively for at least one said driving bit 9 to be received therein, in this embodiment, each said receiving member 421 is for two said driving bits 9 to be received therein, two sides of one of two receiving members 421 neighboring to each other respectively have a protrusion 51, two sides of the other of two receiving members 421 neighboring to each other respectively have a slide groove 52, and the two protrusions 51 are respectively rotatably and slidably arranged within the two slide grooves 52.

Figure 4:
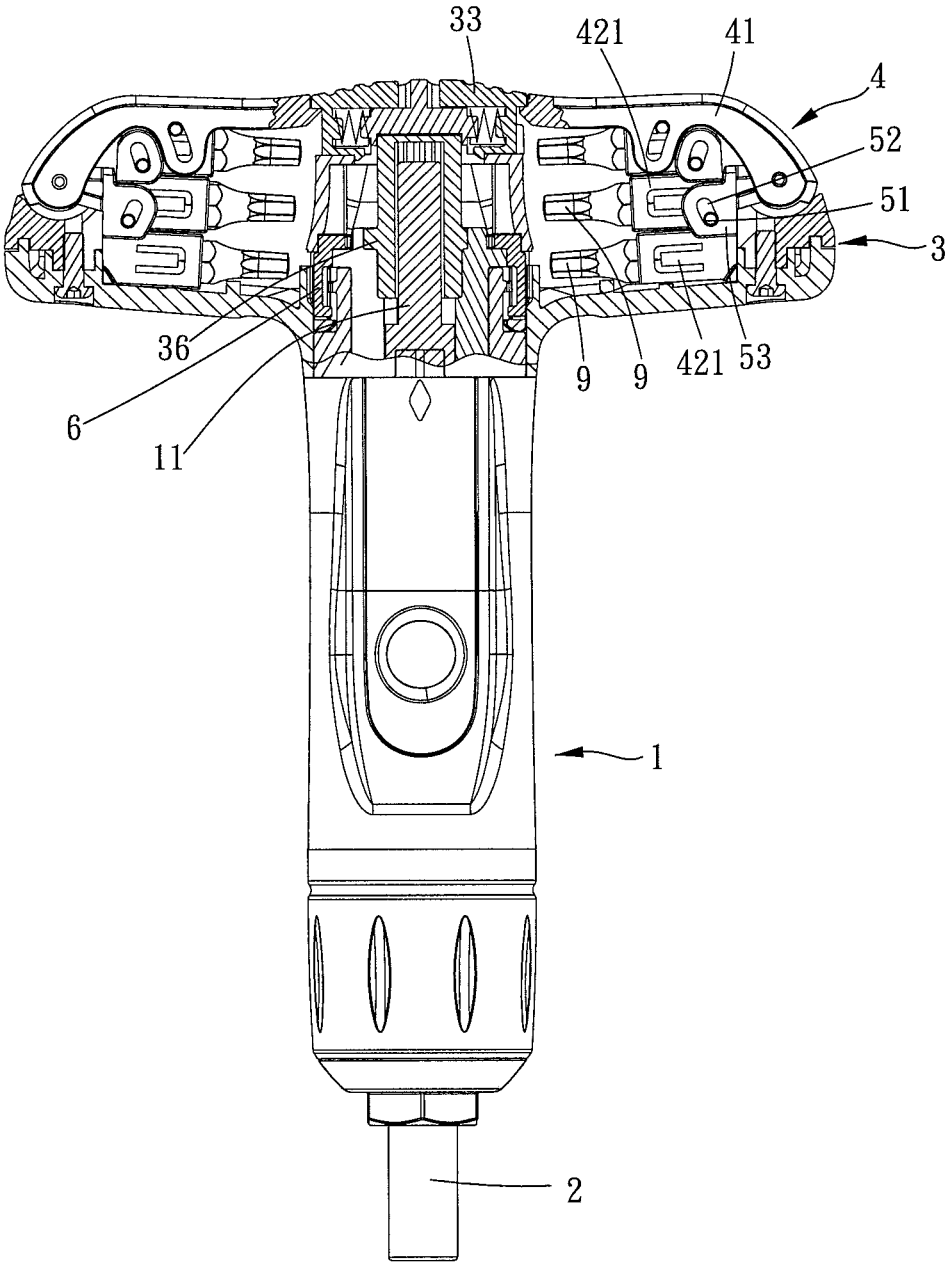
FIGS. 4 and 5 are drawings showing the preferred embodiment of the present invention in operation.
Figure 5:
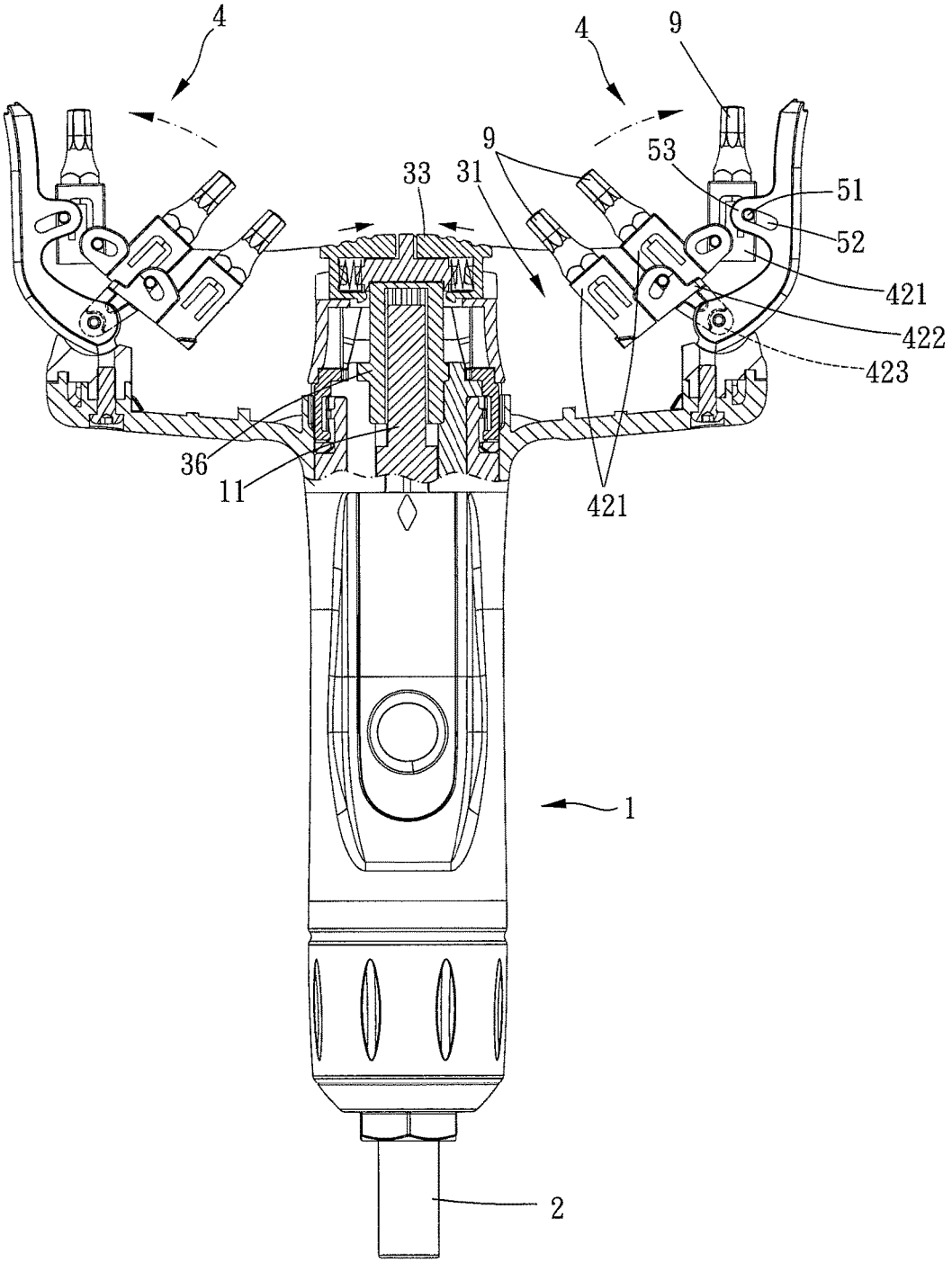

Furthermore, two sides of one of the cover 41 and one said receiving member 421 near the cover 41 respectively have one said protrusion 51, two sides of the other of the cover 41 and one said receiving member 421 near the cover 41 respectively have one said slide groove 52, in this embodiment, the slide groove 52 is formed on the cover 41, the two protrusions 51 are respectively rotatably and slidably arranged within the two slide grooves 52, when the cover 41 is folded to cover the receiving groove 31, the receiving members 421 and the cover 41 are tightly arranged next to each other along the axial direction (as shown in FIG. 4) to save a space of the receiving groove 31 and prevent a volume of the grip portion 3 from being too large; when the cover 41 swings away from the receiving groove 31, the cover 41 drives the receiving members 421 to swing outward, and the receiving members 421 and the cover 41 swing away from each other to spread out in a fan shape (as shown in FIG. 5) so that the driving bits 9 will not be too crowded, and a user can take up one said driving bit 9 easily.

In this embodiment, the cover 41 which has the two slide grooves 52 and the receiving members 421 respectively extend obliquely to form two protrusive ears 53, and the two protrusive ears 53 respectively have one said slide groove 52 so that the receiving members 421 can swing away from each other in greater angle for the user to take up the driving bit 9 more easily.

Specifically, each said cover 41 and the grip portion 3 are pivoted to an axle 54, the receiving member 421 of each said receiving portion 42 away from the cover 41 has an extension section 422, the extension section 422 further has a pivoting block 423, the pivoting block 423 is pivoted to the axle 54, and the extension section 422 of the receiving member 421 is blocked by a bottom portion of another said receiving member 421 neighboring to the receiving member 421 so as to prevent each said receiving portion 42 swinging away from the receiving member 421 of the cover 41 too widely and prevent the two driving bits 9 received in the receiving member 421 from falling off.

Preferably, the grip portion 3 has at least one bouncing member 33, the at least one bouncing member 33 corresponds to the receiving grooves 31 in number, each said bouncing member 33 corresponds to a free end of the cover 41, the bouncing member 33 normally bounces toward a bouncing position, and when the cover 41 is folded to cover the receiving groove 31, the bouncing member 33 is engaged with the free end of the cover 41 to prevent the cover 41 from swinging randomly.

Given the above, in the torque driving tool of the present invention, when the cover is folded to cover the receiving groove, the receiving portion can save the space of the receiving groove, and the volume of the grip portion can be prevented from being too large; when the cover swings away from the receiving groove, the cover drives the receiving portion to swing outward, and the receiving portion and the cover swing away from each other to spread out in a fan shape so that the driving bits will not be too crowded, and the user can take up one said driving bit easily.

While we have shown and described various embodiments in accordance with the present invention, it should be clear to those skilled in the art that further embodiments may be made without departing from the scope of the present invention.

What is claimed is:

1. A torque driving tool, including:

a main body, having an axial direction;

a working portion, disposed on one of two ends of the main body for being assembled to a driving bit;

a grip portion, disposed on one of the two ends of the main body opposite to the working portion, selectively rotatable relative to the main body, having at least one receiving groove;

at least one receiving device, each said receiving device including a cover and a receiving portion which is for at least one said driving bit to be received therein, the cover being pivoted to the grip portion, the receiving portion being swingably pivoted to the cover;

wherein the receiving portion includes a plurality of receiving members, said receiving members are respectively for at least one said driving bit to be received therein, two sides of one of two of said receiving members neighboring to each other respectively have a protrusion, two sides of the other of the two of said receiving members neighboring to each other respectively have a slide groove, and the two protrusions are respectively rotatably and slidably arranged within the two slide grooves.

2. The torque driving tool of claim 1, wherein the grip portion has at least one arm portion which extends radially, each said arm portion has one said receiving groove, and the covers are respectively pivoted to one of two ends of the arm portions which are radially away from each other.

3. The torque driving tool of claim 1, wherein two sides of one of the cover and one said receiving member near the cover respectively have one said protrusion, two sides of the other of the cover and one said receiving member near the cover respectively have one said slide groove, the two protrusions are respectively rotatably and slidably arranged within the two slide grooves, when the cover is folded to cover the receiving groove, the receiving members and the cover are tightly arranged next to each other along the axial direction; when the cover swings away from the receiving groove, the cover drives the receiving members to swing outward, and the receiving members and the cover swing away from each other to spread out in a fan shape.

4. The torque driving tool of claim 3, wherein the cover which has the two slide grooves and the at least one receiving member respectively extend obliquely to form two protrusive ears, and the two protrusive ears respectively have one said slide groove.

5. The torque driving tool of claim 4, wherein each said cover and the grip portion are pivoted to an axle, the receiving member of each said receiving portion away from the cover has an extension section, the extension section further has a pivoting block, the pivoting block is pivoted to the axle, and the extension section of the receiving member is blocked by a bottom portion of another said receiving member neighboring to the receiving member.

6. The torque driving tool of claim 1, wherein the grip portion has at least one bouncing member, each said bouncing member corresponds to a free end of the cover, the bouncing member normally bounces toward a bouncing position, and when the cover is folded to cover the receiving groove, the bouncing member is engaged with the free end of the cover.

7. A torque driving tool, including:

a main body, having an axial direction;

a working portion, disposed on one of two ends of the main body for being assembled to a driving bit;

a grip portion, disposed on one of the two ends of the main body opposite to the working portion, selectively rotatable relative to the main body, having at least one receiving groove;

at least one receiving device, each said receiving device including a cover and a receiving portion which is for at least one said driving bit to be received therein, the cover being pivoted to the grip portion, the receiving portion being swingably pivoted to the cover;

wherein the grip portion includes an upper shell and a lower shell which are assembled to each other, the lower shell is close to the main body, the upper shell is remote from the main body, one side of the upper shell remote from the main body has the at least one receiving groove, an actuating member is non-rotatably arranged in the lower shell, the main body has a torque adjusting member, the torque adjusting member is non-rotatably inserted in the actuating member, and the grip portion is selectively axially movable between a locked position and an adjustable position; when the grip portion is on the locked position, the grip portion and the main body are non-rotatable relative to each other; and when the grip portion is on the adjustable position, the grip portion is rotatable relative to the main body, and the actuating member drives the torque adjusting member to rotate;

wherein an outer circumferential wall of the actuating member has an exterior annular toothed portion, the lower shell has an interior annular toothed portion which is selectively meshed with the exterior annular toothed portion, when the interior annular toothed portion is non-meshed with the exterior annular toothed portion, a relative angle of the grip portion and the main body is adjustable by rotating the grip portion and the actuating member relative to each other, the actuating member further has a non-circular through hole, the torque adjusting member is inserted through the non-circular through hole, and the torque adjusting member corresponds to the non-circular through hole in shape.

8. The torque driving tool of claim 7, wherein the grip portion has at least one arm portion which extends radially, each said arm portion has one said receiving groove, and the covers are respectively pivoted to one of two ends of the arm portions which are radially away from each other; the receiving portion includes a plurality of receiving members, said receiving members are respectively for at least one said driving bit to be received therein, two sides of one of two of said receiving members neighboring to each other respectively have a protrusion, two sides of the other of the two of said receiving members neighboring to each other respectively have a slide groove, and the two protrusions are respectively rotatably and slidably arranged within the two slide grooves; two sides of one of the cover and one said receiving member near the cover respectively have one said protrusion, two sides of the other of the cover and one said receiving member near the cover respectively have one said slide groove, the two protrusions are respectively rotatably and slidably arranged within the two slide grooves, when the cover is folded to cover the receiving groove, the receiving members and the cover are tightly arranged next to each other along the axial direction; when the cover swings away from the receiving groove, the cover drives the receiving members to swing outward, and the receiving members and the cover swing away from each other to spread out in a fan shape; the cover which has the two slide grooves and the at least one receiving member respectively extend obliquely to form two protrusive ears, and the two protrusive ears respectively have one said slide groove; each said cover and the grip portion are pivoted to an axle, the receiving member of each said receiving portion away from the cover has an extension section, the extension section further has a pivoting block, the pivoting block is pivoted to the axle, and the extension section of the receiving member is blocked by a bottom portion of another said receiving member neighboring to the receiving member; the grip portion has at least one bouncing member, each said bouncing member corresponds to a free end of the cover, the bouncing member normally bounces toward a bouncing position, and when the cover is folded to cover the receiving groove, the bouncing member is engaged with the free end of the cover; the torque driving tool further includes at least one restricting member, one of the two ends of the main body near the grip portion further has an engaging portion, the lower shell further has at least one position-restricting portion, one of two ends of each said restricting member is engaged with one said position-restricting portion, when the grip portion is on the locked position, the restricting members are non-engaged with the engaging portion; when the grip portion is on the adjustable position, the restricting members are engaged with the engaging portion.

9. A torque driving tool, including:

a main body, having an axial direction;

a working portion, disposed on one of two ends of the main body for being assembled to a driving bit;

a grip portion, disposed on one of the two ends of the main body opposite to the working portion, selectively rotatable relative to the main body, having at least one receiving groove;

at least one receiving device, each said receiving device including a cover and a receiving portion which is for at least one said driving bit to be received therein, the cover being pivoted to the grip portion, the receiving portion being swingably pivoted to the cover;

at least one restricting member;

wherein the grip portion includes an upper shell and a lower shell which are assembled to each other, the lower shell is close to the main body, the upper shell is remote from the main body, one side of the upper shell remote from the main body has the at least one receiving groove, an actuating member is non-rotatably arranged in the lower shell, the main body has a torque adjusting member, the torque adjusting member is non-rotatably inserted in the actuating member, and the grip portion is selectively axially movable between a locked position and an adjustable position; when the grip portion is on the locked position, the grip portion and the main body are non-rotatable relative to each other; and when the grip portion is on the adjustable position, the grip portion is rotatable relative to the main body, and the actuating member drives the torque adjusting member to rotate;

wherein one of the two ends of the main body near the grip portion further includes an engaging portion, the lower shell further includes at least one position-restricting portion, one of two ends of each said restricting member is engaged with one said position-restricting portion, when the grip portion is on the locked position, the restricting members are non-engaged with the engaging portion; when the grip portion is on the adjustable position, the restricting members are engaged with the engaging portion.

* * * * *